US009158278B2

(12) United States Patent
Yamashita et al.

(10) Patent No.: US 9,158,278 B2
(45) Date of Patent: Oct. 13, 2015

(54) IMAGE FORMING APPARATUS HAVING AIRFLOW GENERATING SECTION AND SHIELD MEMBER IN CONVEYANCE UNIT

(71) Applicant: KYOCERA Document Solutions Inc., Osaka (JP)

(72) Inventors: Kazuya Yamashita, Osaka (JP); Kosuke Uchida, Osaka (JP); Yasuhiro Tauchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/467,552

(22) Filed: Aug. 25, 2014

(65) Prior Publication Data

US 2015/0063856 A1 Mar. 5, 2015

(30) Foreign Application Priority Data

Aug. 28, 2013 (JP) ..... 2013-176510
Aug. 28, 2013 (JP) ..... 2013-176511

(51) Int. Cl.
*G03G 21/20* (2006.01)
*G03G 15/00* (2006.01)

(52) U.S. Cl.
CPC ..... *G03G 21/206* (2013.01); *G03G 15/6529* (2013.01); *G03G 2221/1645* (2013.01)

(58) Field of Classification Search
CPC ..... G03G 15/6529; G03G 15/6573; G03G 21/206; G03G 2215/00421; G03G 2215/0043; G03G 2215/00438; G03G 2221/1645
USPC ..... 399/92, 401
See application file for complete search history.

(56) References Cited

U.S. PATENT DOCUMENTS

| | | | | |
|---|---|---|---|---|
| 5,510,827 | A * | 4/1996 | Kubota et al. | 347/257 |
| 2006/0269321 | A1* | 11/2006 | Kang | 399/124 |
| 2007/0019981 | A1* | 1/2007 | Kawamata | 399/92 |
| 2009/0220271 | A1* | 9/2009 | Aratachi et al. | 399/92 |
| 2010/0054791 | A1* | 3/2010 | Shimizu | 399/92 |
| 2014/0086615 | A1* | 3/2014 | Yasuda | 399/94 |

FOREIGN PATENT DOCUMENTS

| | | | |
|---|---|---|---|
| JP | 2000-304395 | A | 11/2000 |
| JP | 2008164902 | A * | 7/2008 |

* cited by examiner

*Primary Examiner* — Robert Beatty
(74) *Attorney, Agent, or Firm* — Studebaker & Brackett PC

(57) ABSTRACT

An image forming apparatus includes a sheet conveyance passage, a photosensitive drum, a transfer unit, a fixing section, a conveyance unit, one or more detection sensors, an airflow generating section, a cooling airflow passage, and a shielding member. The conveyance unit is at an opposite side of the transfer unit from the photosensitive drum with a predetermined clearance from the transfer unit. Each detection sensor is disposed to face the transfer unit in cross section intersecting the axial direction of the photosensitive drum. The sheet detection sensor performs a predetermined detection. The airflow generating section causes a cooling airflow to flow between the transfer unit and the conveyance unit in the axial direction. The cooling airflow passage guides the cooling airflow toward each detection sensor. The shielding member blocks an airflow from a location around the transfer unit toward the cooling airflow passage in a direction intersecting the axial direction.

16 Claims, 14 Drawing Sheets

IMAGE FORMING APPARATUS HAVING AIRFLOW GENERATING SECTION AND SHIELD MEMBER IN CONVEYANCE UNIT

INCORPORATION BY REFERENCE

The present application claims priority under 35 U.S.C. §119 to Japanese Patent Applications No. 2013-176510 and No. 2013-176511 both filed Aug. 28, 2013. The contents of the applications are incorporated herein by reference in their entirety.

BACKGROUND

The present disclosure relates to image forming apparatuses for forming an image on a sheet.

Devices known for forming an image on a sheet include image forming apparatuses. An image forming apparatus includes a conveyance motor and a guide member inside the main body, and the temperature of the conveyance motor and the guide member tends to be high. For cooling the conveyance motor and the guide member, a type of an image forming apparatus is further provided with a fan and a duct. The airflow generated by the fan is directed to the guide member through an opening formed in the duct. The airflow is further guided along the guide surface of the duct toward the conveyance motor.

SUMMARY

An image forming apparatus according to the present disclosure includes a sheet conveyance passage, a photosensitive drum, a transfer unit, a fixing section, a conveyance unit, at least one detection sensor, an airflow generating section, a cooling airflow passage, and a shielding member. Through the sheet conveyance passage, a sheet is conveyed in a predetermined conveyance direction. The photosensitive drum is disposed to face the sheet conveyance passage. The photosensitive drum has an axis and a peripheral surface and configured to axially rotate and bear a toner image on the peripheral surface. The transfer unit includes a conveyance belt. The conveyance belt is disposed to face the photosensitive drum across the sheet conveyance passage. The conveyance belt is configured to circulate. The conveyance belt forms a nip part with the photosensitive drum. The transfer unit passes the sheet through the nip part to cause the toner image to be transferred to the sheet. The fixing section is disposed downstream from the nip part in the conveyance direction. The fixing section conducts a fixing process on the sheet to which the toner image has been transferred. The conveyance unit is disposed at an opposite side of the transfer unit from the photosensitive drum with a predetermined clearance from the transfer unit. The conveyance unit conveys the sheet having been subjected to the fixing process back into the sheet conveyance passage at a location upstream from the nip part in the conveyance direction. The at least one detection sensor is disposed in the conveyance unit so as to face the transfer unit in a cross section intersecting an axial direction of the photosensitive drum. The at least one detection sensor performs a predetermined detection. The airflow generating section causes a cooling airflow to flow between the transfer unit and the conveyance unit in the axial direction. The cooling airflow passage is disposed between the transfer unit and the conveyance unit. The cooling airflow passage guides the cooling airflow toward the at least one detection sensor. The shielding member is disposed in the clearance between the transfer unit and the conveyance unit to extend in the axial direction. The shielding member blocks an airflow from a location around the transfer unit toward the cooling airflow passage in a direction intersecting the axial direction.

DETAILED DESCRIPTION

Figure 1:
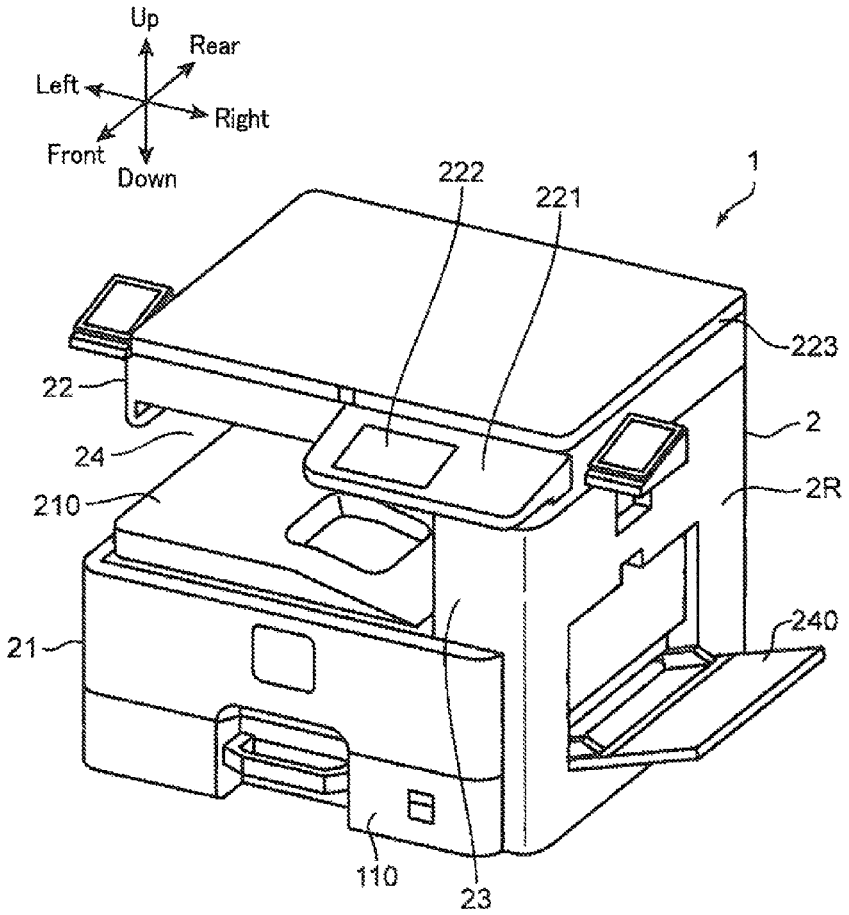
FIG. 1 is a perspective view of an image forming apparatus according to an embodiment of the present disclosure.
Figure 2:
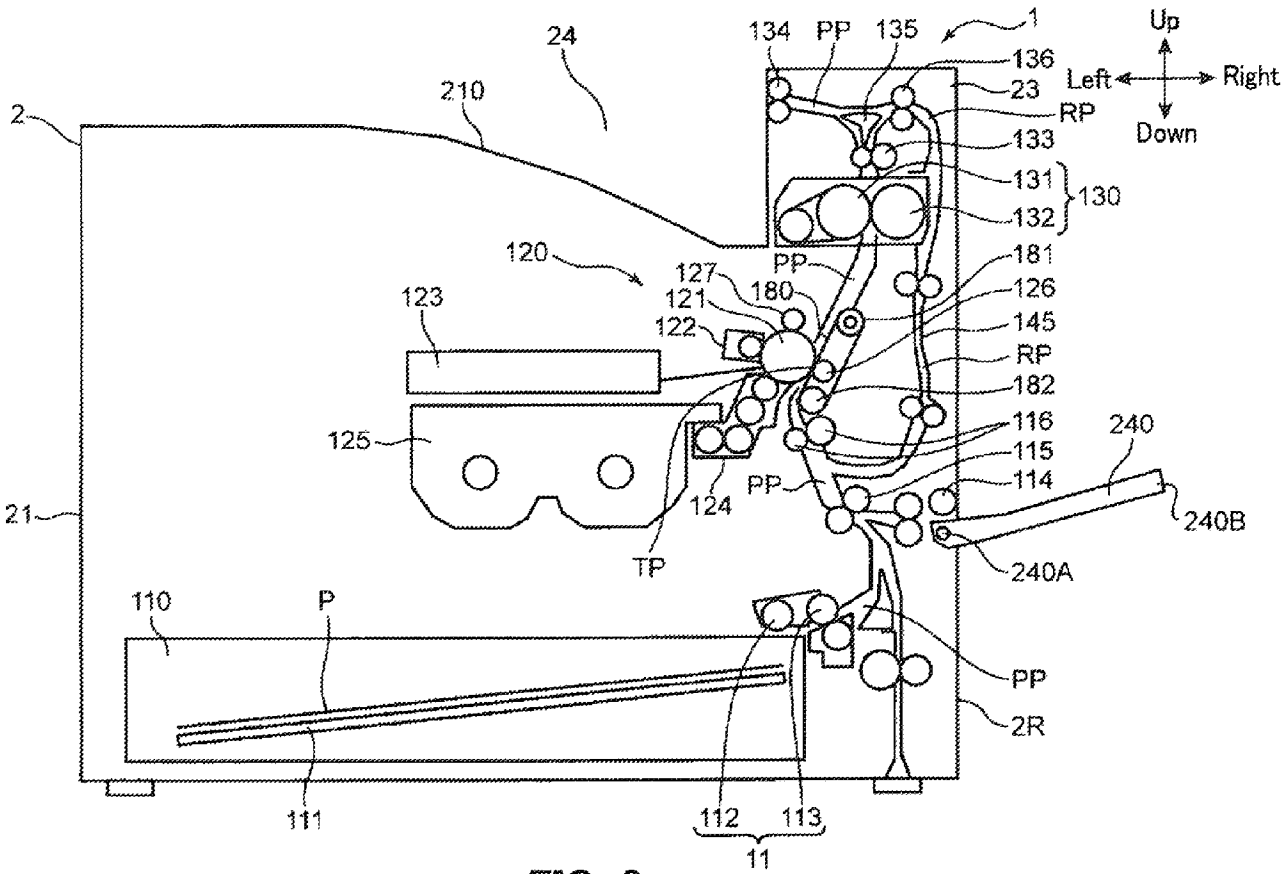
FIG. 2 is an internal cross-sectional view of the image forming apparatus according to the embodiment of the present disclosure.

The following describes an embodiment of the present disclosure, with reference to the accompanying drawings. FIG. 1 is a perspective view of an image forming apparatus 1 according to the embodiment of the present disclosure. FIG. 2 is a schematic illustration of the internal structure of the image forming apparatus 1 shown in FIG. 1. Note that FIG. 2 does not show an upper housing 22 shown in FIG. 1. The image forming apparatus 1 shown in FIGS. 1 and 2 is what is called a monochrome printer. However, according to another embodiment, the image forming apparatus may be a color printer, a facsimile machine, a multifunction peripheral combining these functions, or another device for forming a toner image on a sheet. Note that the terms describing the directions such as "up", "down", "front", "rear", "left", and "right" used in the description below are simply for the purpose of clarifying the description and not intended to limit the principle of the image forming apparatus. In addition, the term "sheet" used in the description refers to any of copy paper, coat paper, overhead projector (OHP) sheet, thick paper, postcard, tracing paper, and a sheet material subjected to an image forming process or to a process other than an image forming process.

The image forming apparatus 1 includes a main housing 2 having a substantially rectangular parallelepiped shape. The main housing 2 includes a lower housing 21 having a substantially rectangular parallelepiped shape, the upper housing 22 having a substantially rectangular parallelepiped shape, and a connecting housing 23. The upper housing 22 is disposed above the lower housing 21. The connecting housing 23 connects the lower housing 21 and the upper housing 22. The connecting housing 23 extends along the right edge and the rear edge of the main housing 2. The lower housing 21, the upper housing 22, and the connecting housing 23 surround a discharge space 24 into which a sheet having been subjected to a print process is discharged.

The upper housing 22 is provided with an operation section 221 projecting toward the front and including a liquid crystal display (LCD) touch panel 222, for example. The operation section 221 is for inputting information related to an image forming process. For example, by operating the LCD touch panel 222, the user can input the number of sheets to be printed and a desired print density. The upper housing 22 accommodates an electronic circuit for controlling a device that is mainly for reading an image of an original document and the entire image forming apparatus 1.

The upper housing 22 is provided with a pressure cover 223 at the top for holding an original document down. The pressure cover 223 is secured to the upper housing 22 to be swingable up and down. The user swings the pressure cover 223 upward and places an original document on the upper housing 22. Thereafter, the user can operate the operation section 221 to cause the device disposed inside the upper housing 22 to read an image of the original document.

The lower housing 21 is provided with a manual feed tray 240 on the right surface. The manual feed tray 240 is swingable up and down with its lower edge 240A (FIG. 2) as the pivot and its upper edge 240B as the swinging edge. With the manual feed tray 240 swung downward into a position projecting toward the right form the lower housing 21, the user can place a sheet on the manual feed tray 240. In accordance with an instruction input on the operation section 221 by the user, the sheet placed on the manual feed tray 240 is drawn into the lower housing 21, subjected to an image forming process, and discharged into the discharge space 24.

As shown in FIG. 2, the image forming apparatus 1 includes a cassette 110, a paper feed section 11, a second paper feed roller 114, an intermediate roller pair 115, a registration roller pair 116, and an image forming section 120. The paper feed section 11 includes a pickup roller 112 and a first paper feed roller pair 113. The paper feed section 11 feeds a sheet P into a sheet conveyance passage PP. The sheet conveyance passage PP extends from the paper feed section 11 and passes through the intermediate roller pair 115, the registration roller pair 116, and finally a transfer nip TP (nip part) formed inside the image forming section 120. The sheet P is conveyed through the sheet conveyance passage PP in a conveyance direction from a downward location to an upward location.

The cassette 110 stores therein sheets P. The cassette 110 can be pulled out of the lower housing 21 toward the front (toward the surface of FIG. 2). The sheets P stored in the cassette 110 are sequentially forwarded upward within the lower housing 21. Thereafter, in accordance with an instruction input on the operation section 221 by the user, the sheet P is subjected to an image forming process in the lower housing 21 and discharged into the discharge space 24. The cassette 110 includes a lift plate 111 for supporting the sheets P. The lift plate 111 is inclined to push the sheets P upward along their leading edges.

The pickup roller 112 makes contact with the leading edge of the topmost one of the sheets P pushed upward by the lift plate 111. When the pickup roller 112 rotates, the topmost sheet P is pulled out of the cassette 110.

The first paper feed roller pair 113 is disposed downstream from the pickup roller 112 in the conveyance direction of the sheet P (hereinafter, "sheet conveyance direction"). The first paper feed roller pair 113 forwards the sheet P further in the downstream direction. The second paper feed roller 114 is disposed inwardly of the manual feed tray 240. The second paper feed roller 114 pulls the sheet P placed on the manual feed tray 240 into the lower housing 21. The user can selectively use the sheet P stored in the cassette 110 or the sheet P placed on the manual feed tray 240.

The intermediate roller pair 115 is disposed downstream from the first paper feed roller pair 113 and the second paper feed roller 114 in the sheet conveyance direction. The intermediate roller pair 115 forwards the sheet P pulled by the first paper feed roller pair 113 or the second paper feed roller 114 further in the downward direction.

Figure 3:
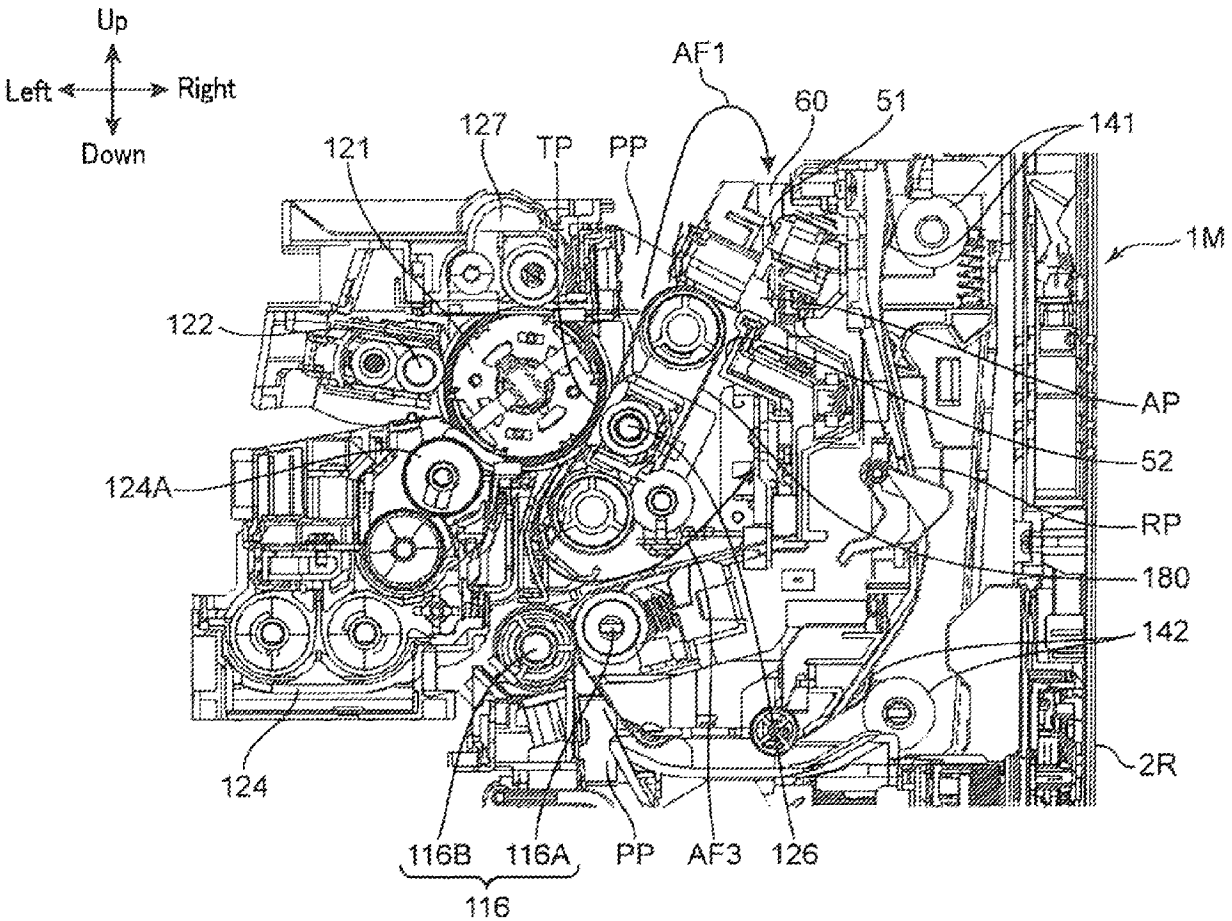
FIG. 3 is a cross-sectional view showing, on an enlarged scale, a part of the image forming apparatus according to the embodiment of the present disclosure.

The registration roller pair 116 regulates the position of the sheet P in the direction perpendicular to the sheet conveyance direction. As a result, the position of an image to be formed on the sheet P is adjusted. The registration roller pair 116 forwards the sheet P to the image forming section 120 in timed relation to the toner image transfer to the sheet P by the image forming section 120. In addition, the registration roller pair 116 has the function of correcting the angle (skew) of the sheet P. The registration roller pair 116 includes a driven roller 116A and a registration roller 116B (FIG. 3).

As shown in FIG. 2, the image forming section 120 includes a photosensitive drum 121, an electrostatic charger 122, an exposure device 123, a developing device 124, a toner container 125, a transfer roller 126, a conveyance belt 180, and a cleaning device 127.

The photosensitive drum 121 is disposed to face the sheet conveyance passage PP. The photosensitive drum 121 is driven to rotate on its axis. The photosensitive drum 121 has the shape of a cylinder. On the peripheral surface of the photosensitive drum 121, an electrostatic latent image is formed. The photosensitive drum 121 bears a toner image conforming to the electrostatic latent image.

To the electrostatic charger 122 receives a predetermined voltage applied thereto. Then, the electrostatic charger 122 charges the peripheral surface of the photosensitive drum 121 substantially uniformly. The exposure device 123 emits laser light to irradiate the peripheral surface of the photosensitive drum 121 charged by the electrostatic charger 122. The laser light is emitted according to the image data output from an external device (not shown), such as a personal computer, connected to the image forming apparatus 1 in a manner to enable communications with the image forming apparatus 1. As a result, an electrostatic latent image conforming to the image data is formed on the peripheral surface of the photosensitive drum 121.

The developing device 124 supplies toner to the peripheral surface of the photosensitive drum 121 bearing the electrostatic latent image formed thereon. The toner container 125 supplies toner to the developing device 124. The toner container 125 supplies toner to the developing device 124 successively or as needed. The toner supplied from the developing device 124 to the photosensitive drum 121 develops (visualizes) the electrostatic latent image formed on the peripheral surface of the photosensitive drum 121. As a result, the toner image is formed on the peripheral surface of the photosensitive drum 121. The developing device 124 includes a development roller 124A (FIG. 3). The development roller 124A bears toner on its peripheral surface. The development roller 124A is disposed to face the photosensitive drum 121 at a developing position. The development roller 124A is driven to rotate. The development roller 124A supplies toner to the photosensitive drum 121.

The transfer roller 126 is disposed to face the peripheral surface of the photosensitive drum 121. The transfer roller 126 is in contact with the inner peripheral surface of the conveyance belt 180 to press the conveyance belt 180 against the photosensitive drum 121. The transfer roller 126 receives transfer bias voltage applied by a bias applying section (not shown).

The conveyance belt 180 is disposed to face the photosensitive drum 121 across the sheet conveyance passage PP. The conveyance belt 180 is formed of an endless belt. The conveyance belt 180 is driven to circulate. The conveyance belt 180 is disposed such that the transfer nip TP is formed between the conveyance belt 180 and the photosensitive drum 121. The conveyance belt 180 carries a sheet P on its surface to pass the sheet P through the transfer nip TP. The conveyance belt 180 transmits a rotational drive force to the transfer roller 126 from its inner peripheral surface. The conveyance belt 180 is tautly stretched between a tension roller 182 and a drive roller 181 respectively disposed at the locations upstream and downstream from the transfer roller 126 in the sheet conveyance direction. The drive roller 181 receives a rotational drive force from a driving mechanism (not shown) and rotates the conveyance belt 180. The transfer roller 126 and the tension roller 182 rotate together with the conveyance belt 180 and thus at the same speed as the conveyance belt 180. When a sheet P passes through the transfer nip TP, the toner image formed on the peripheral surface of the photosensitive drum 121 is transferred to the sheet P.

The cleaning device 127 removes residual toner from the peripheral surface of the photosensitive drum 121 after the toner image is transferred to the sheet P. The peripheral surface of the photosensitive drum 121 as cleaned by the cleaning device 127 again passes a location below the electrostatic charger 122 to be uniformly charged. Thereafter, a new toner image is formed.

The image forming apparatus 1 further includes a fixing device 130 (FIG. 2) (fixing section) at a location downstream from the image forming section 120 (transfer nip TP) in the sheet conveyance direction. The fixing device 130 conducts a fixing process on the sheet P having the toner image transferred thereto. The fixing device 130 includes a heating roller 131 for fusing the toner on the sheet P and a pressure roller 132 for placing the sheet P into intimate contact with the heating roller 131. When the sheet P passes between the heating roller 131 and the pressure roller 132, the toner image is fixed to the sheet P.

The image forming apparatus 1 further includes an upper conveyance roller pair 133 and an ejection roller pair 134. The upper conveyance roller pair 133 is disposed downstream from the fixing device 130 in the sheet conveyance direction. The ejection roller pair 134 is disposed downstream from the upper conveyance roller pair 133 in the sheet conveyance direction. The sheet P is ejected from the lower housing 21 by the upper conveyance roller pair 133 and the ejection roller pair 134. The sheet P ejected from the lower housing 21 is stacked on an upper wall 210.

Figure 4:
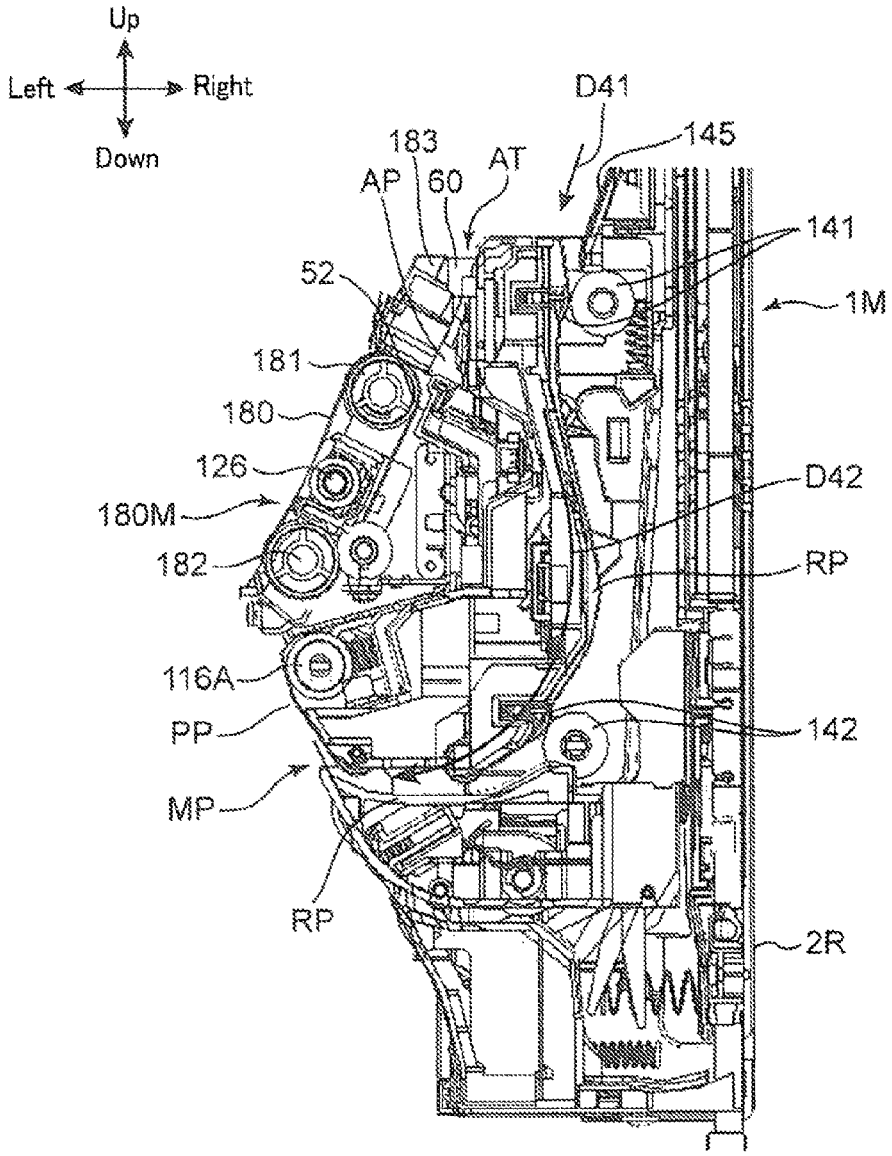
FIG. 4 is a cross-sectional view showing a part of FIG. 3 in a further enlarged scale.
Figure 5:
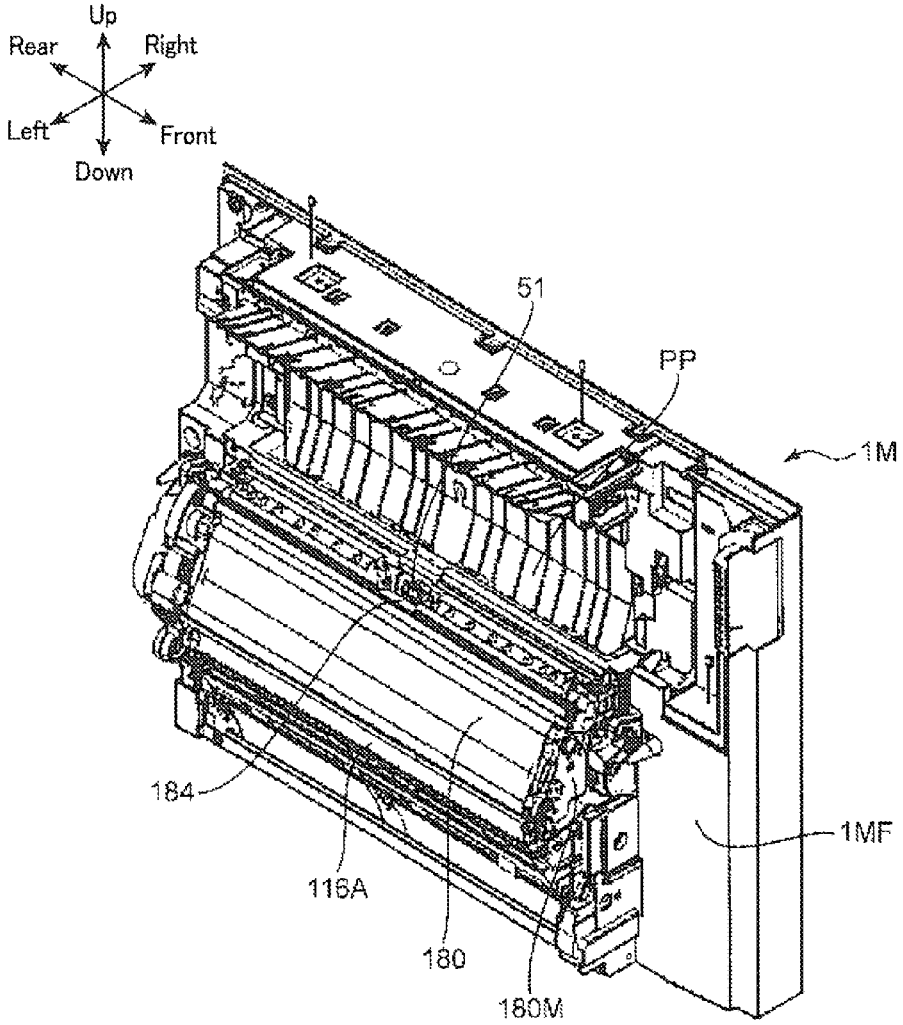
FIG. 5 is a perspective view of a transfer unit and a conveyance unit of the image forming apparatus according to the embodiment of the present disclosure.
Figure 6:
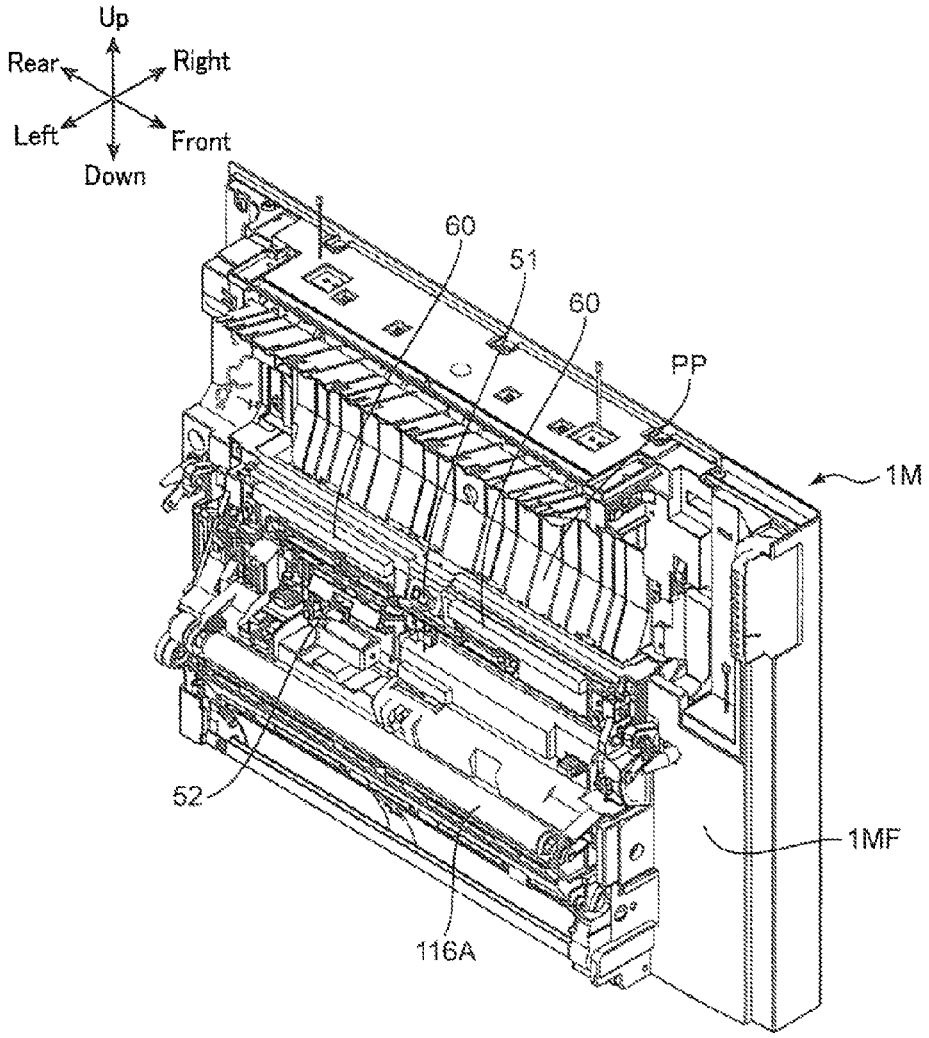
FIG. 6 is a perspective view of the conveyance unit shown in FIG. 5, with the transfer unit removed.
Figure 7:
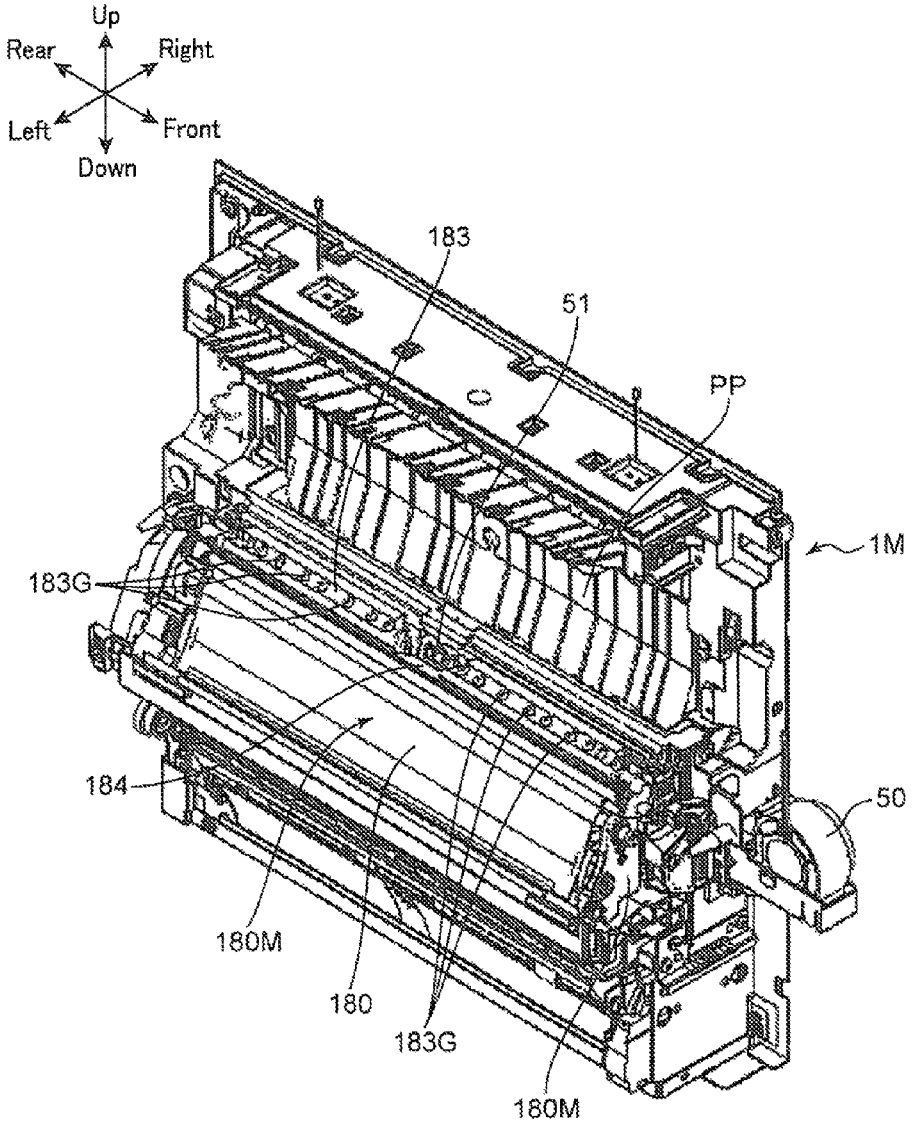
FIG. 7 is a perspective view of the conveyance unit shown in FIG. 5, with a front upright wall removed.
Figure 8:
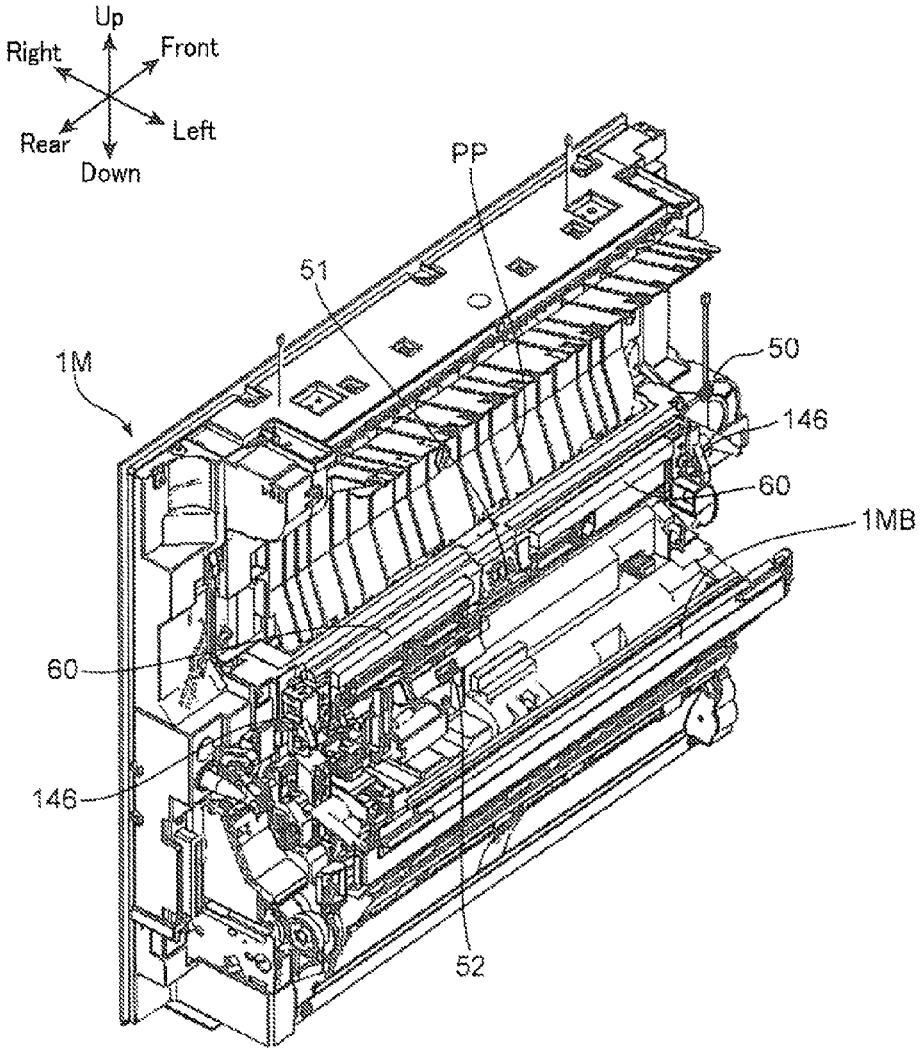
FIG. 8 is a perspective view of the conveyance unit according to the embodiment, with the transfer unit and the front upright wall removed.
Figure 9:
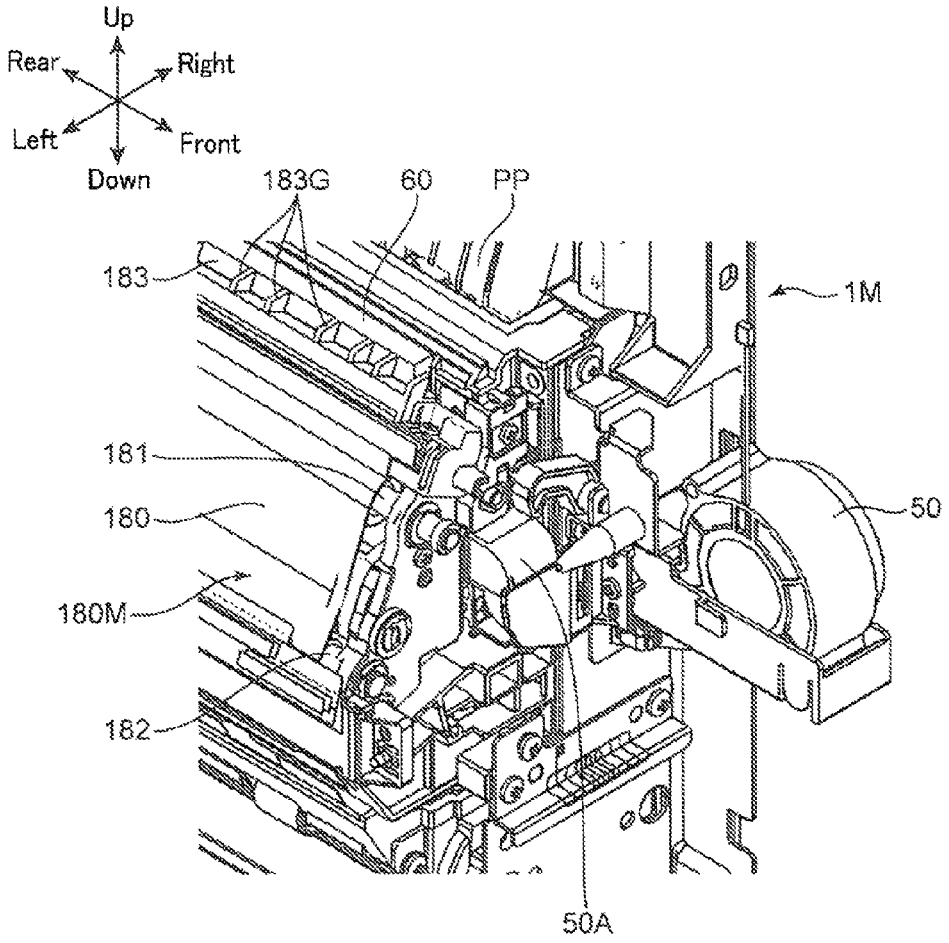
FIG. 9 is a perspective view showing, on an enlarged scale, a part around an airflow generating section of the conveyance unit according to the embodiment of the present disclosure.

Next, with reference to FIGS. 2 and 3-9, the following describes a transfer unit 180M and a conveyance unit 1M according to the present embodiment. FIG. 3 is a cross-sectional view showing, on an enlarged scale, a part of the image forming apparatus 1 shown in FIG. 2. More specifically, FIG. 3 is a cross-sectional view showing, on an enlarged scale, a part around the photosensitive drum 121 and the conveyance belt 180. FIG. 4 is a cross-sectional view showing, on a further enlarged scale, a part of the cross section shown in FIG. 3. Note that the photosensitive drum 121 is not visible in FIG. 4. FIG. 5 is a perspective view showing the conveyance unit 1M and the transfer unit 180M of the image forming apparatus 1 according to the present embodiment. FIG. 6 is a perspective view showing the conveyance unit 1M shown in FIG. 5, with the transfer unit 180M removed. FIG. 7 is a perspective view showing the conveyance unit 1M shown in FIG. 5, with a front upright wall 1MF removed. FIG. 8 is a perspective view showing the conveyance unit 1M, with the transfer unit 180M and the front upright wall 1MF removed. FIG. 9 is a perspective view showing, on an enlarged scale, a part around a sirocco fan 50 included in the conveyance unit 1M.

As shown in FIGS. 4 and 5, the image forming apparatus 1 includes the transfer unit 180M. The transfer unit 180M includes the conveyance belt 180, the drive roller 181, the tension roller 182, and the transfer roller 126 all of which are integrally supported. The transfer unit 180M has a function of conveying a sheet P to pass through the transfer nip TP where the toner image is transferred to the sheet P. The transfer unit 180M is mounted to the conveyance unit 1M, which will be described later.

As shown in FIGS. 4 and 7-9, the transfer unit 180M includes a guide section 183. In the transfer unit 180M, the guide section 183 extends above the drive roller 181 in the front-to-rear direction (the axial direction of the photosensitive drum 121). The guide section 183 has a function of guiding the sheet P detached from the conveyance belt 180 in the sheet conveyance direction. The guide section 183 has a plurality of guide ribs 183G and a cutaway portion 184 (FIG. 7).

The guide ribs 183G are disposed in spaced relationship in the front-to-rear direction of the guide section 183. The sheet P is guided along the guide ribs 183G toward the fixing device 130. The cutaway portion 184 is a concaved portion formed at a central location of the guide section 183 in the front-to-rear direction. The cutaway portion 184 is formed to partly expose the conveyance unit 1M, which will be described later, toward the sheet conveyance passage PP at a location downstream from the conveyance belt 180 in the sheet conveyance direction.

The image forming apparatus 1 further includes the conveyance unit 1M. The conveyance unit 1M is disposed in the main housing 2 at the side toward a right wall 2R (FIGS. 1 and 2). More specifically, the conveyance unit 1M is disposed at an opposite side of the transfer unit 180M from the photosensitive drum 121 (at the right side of the transfer unit 180M) with a predetermined clearance from the transfer unit 180M. The conveyance unit 1M is disposed in the right end portion of the main housing 2 to extend in the front-to-rear and up-and-down directions. That is, the right wall 2R of the main housing 2 is provided with the conveyance unit 1M. The conveyance unit 1M conveys the sheet P having been subjected to the fixing process back into the sheet conveyance passage PP at a location upstream from the transfer nip TP in the sheet conveyance direction. The conveyance unit 1M includes a reverse conveyance passage RP, a first conveyance roller pair 141, a second conveyance roller pair 142, a reverse guide section 145, and the front upright wall 1MF.

The reverse conveyance passage RP is for conveying the sheet P back to the transfer nip TP. The first conveyance roller pair 141 and the second conveyance roller pair 142 are each disposed at an appropriate location in the reverse conveyance passage RP. The first conveyance roller pair 141 and the second conveyance roller pair 142 are for conveying a sheet P. As shown in FIGS. 2 and 4, the reverse guide section 145 is a guide wall located above the transfer unit 180M to define the right side of the reverse conveyance passage RP. As shown in FIG. 5, the front upright wall 1MF is a wall that is upright at a front part of the conveyance unit 1M to face toward the left.

As shown in FIG. 2, the sheet P having been subjected to the fixing process by the fixing device 130 is conveyed upward by the upper conveyance roller pair 133. In a two-sided print mode of forming an image also on the rear side of the sheet P, a switch guide 135 is rotated to switch the conveyance direction of the sheet P to the right. As a result, the sheet P is conveyed by a reverse conveyance roller 136 into the reverse conveyance passage RP. As shown in FIG. 4, the sheet P is first conveyed downward in the reverse conveyance passage RP (an arrow D41 in FIG. 4) and further conveyed by the first conveyance roller pair 141 and the second conveyance roller pair 142 in the direction indicated by an arrow D42 in FIG. 4. Then, the sheet P is conveyed back into the sheet conveyance passage PP at a conveyance merging point MP located upstream from the transfer nip TP. When the sheet P is conveyed by the registration roller pair 116 and the conveyance belt 180 to again reach the transfer nip TP, a toner image is transferred to the rear side of the sheet P.

As shown in FIG. 4, the transfer unit 180M is supported on the conveyance unit 1M by a pair of tension springs (not shown), with the upper end portion of the transfer unit 180M inclined toward the right. More specifically, the pair of tension springs are disposed on the upper edge portion of the transfer unit 180M at opposite ends in the front-to-rear direction. The respective tension springs engage with a pair of supports 146 (FIG. 8) disposed at opposite ends of the conveyance unit 1M in the front-to-rear direction. In addition, the transfer unit 180M is supported at the lower portion by a bracket 1MB (FIG. 8) provided on the conveyance unit 1M to extend in the front-to-rear direction. The transfer unit 180M and the conveyance unit 1M are disposed to leave a clearance therebetween, and the clearance serves as a cooling airflow passage AP (FIG. 4), which will be described later.

As shown in FIG. 4, the conveyance unit 1M rotatbly supports the driven roller 116A, which is the right one of the rollers in the registration roller pair 116. When the transfer unit 180M is mounted to the conveyance unit 1M, the tension roller 182 comes to be located above the driven roller 116A.

As shown in FIGS. 7 and 8, the conveyance unit 1M includes a sheet detection sensor 51 (detection sensor), a density detection sensor 52 (detection sensor), and the sirocco fan 50 (airflow generating section). In a cross section intersecting the axial direction of the photosensitive drum 121, the sheet detection sensor 51 and the density detection sensor 52 are disposed in the conveyance unit 1M so as to face the transfer unit 180M. The sheet detection sensor 51 and the density detection sensor 52 each perform a predetermined detection.

The sheet detection sensor 51 is disposed in the conveyance unit 1M so as to face the cutaway portion 184 of the transfer unit 180M. As shown in FIG. 8, the sheet detection sensor 51 is disposed at the left and below the reverse guide section 145 and at the central portion of the conveyance unit 1M in the front-to-rear direction. The sheet detection sensor 51 detects, through the cutaway portion 184, the leading or trailing edge of a sheet P being conveyed from the transfer nip TP in the sheet conveyance direction. Detection information obtained by the sheet detection sensor 51 is used to adjust the feed timing of a subsequent sheet P by the registration roller pair 116.

As shown in FIGS. 3, 4, and 8, the density detection sensor 52 is disposed in the conveyance unit 1M so as to face the conveyance belt 180 of the transfer unit 180M. However, the density detection sensor 52 is not visible in FIG. 5 because the transfer unit 180M is mounted to the conveyance unit 1M and thus the density detection sensor 52 is behind the conveyance belt 180. As shown in FIG. 8, in addition, the density detection sensor 52 is disposed at the rear and below the sheet detection sensor 51. The density detection sensor 52 determines the density of a toner image that is for density detection. The density detection toner image is transferred from the photosensitive drum 121 to the conveyance belt 180. As a result, the conveyance belt 180 bears the density detection toner image formed thereon. Therefore, the density of the density detection toner image can be determined with the use of a back side of the conveyance belt 180 with respect to the sheet conveyance passage PP. Density information obtained by the density detection sensor 52 is used to adjust the amount of toner to be supplied to the developing device 124 or the developing bias applied to the development roller 124A.

The sirocco fan 50 is disposed inside the front upright wall 1MF (FIG. 5). More specifically, as shown in FIGS. 7 and 9, the sirocco fan 50 is disposed on the front end portion of the conveyance unit 1M. The sirocco fan 50 causing a cooling airflow to flow between the transfer unit 180M and the conveyance unit 1M toward the rear in the axial direction of the photosensitive drum 121. The sirocco fan 50 has an air outlet 50A (FIG. 9). The air outlet 50A opens toward the rear. The cooling airflow blows out of the air outlet 50A.

As described above, the predetermined clearance is provided between the transfer unit 180M and the conveyance unit 1M. The clearance serves as the cooling airflow passage AP shown in FIG. 3. In other words, the cooling airflow passage AP is formed between the transfer unit 180M and the conveyance unit 1M to guide the cooling airflow toward the sheet detection sensor 51 and the density detection sensor 52.

In the two-sided print mode of forming an image on either side of the sheet P, the sheet P once passed through the fixing device 130 and heated is brought back to the transfer nip TP through the reverse conveyance passage RP. While the sheet P is conveyed from the transfer nip TP along the guide section 183 of the transfer unit 180M, the heat of the sheet P conducts to the sheet detection sensor 51 through the cutaway portion 184. The heat of the sheet P also conducts to the rear surface of the transfer unit 180M via the conveyance belt 180, so that the density detection sensor 52 is heated. If the temperature of the sheet detection sensor 51 or the density detection sensor 52 elevates, the detection accuracy of the corresponding sensor may be reduced or malfunction of the corresponding sensor may be caused. According to the present embodiment, however, the sheet detection sensor 51 is cooled by the cooling airflow to reduce the temperature increase of the sheet detection sensor 51. As a result, the sheet detection sensor 51 can reliably detect the sheet P conveyed from the transfer nip TP. In addition, the cooling airflow also cools the density detection sensor 52 to enable reliable density detection of the density detection toner image. In addition, even if toner particles of the density detection toner image are stirred up from the conveyance belt 180, the cooling airflow prevents the toner particles from adhering to the density detection sensor 52.

If a strong cooling airflow from the sirocco fan 50 enters the cooling airflow passage AP, it is generally possible that a new airflow is induced around the transfer unit 180M. More specifically, as indicated by an arrow AF1 shown in FIG. 3, the new airflow is likely to flow from the transfer nip TP through the location above the transfer unit 180M and enter a clearance AT (FIG. 4) present between the upper end portion of the transfer unit 180M and the conveyance unit 1M. It is noted here that toner particles may scatter at the transfer nip TP when a toner image is transferred from the photosensitive drum 121 to the sheet P as a result of discharge. In addition, according to the present embodiment, the cleaning device 127 is disposed above the transfer nip TP as shown in FIG. 3 for collecting residual toner from the photosensitive drum 121. If the new airflow indicated by the arrow AF1 shown in FIG. 3 contains scattered toner particles, it is generally possible that such toner particles enter the clearance AT and adhere to the sheet detection sensor 51 or the density detection sensor 52. As a result, the sheet detection sensor 51 or the density detection sensor 52 may malfunction.

According to the present embodiment, however, the conveyance unit 1M is provided with a shielding sponge 60 (shield member). The shielding sponge 60 extends in the clearance between the transfer unit 180M and the conveyance unit 1M in the axial direction of the photosensitive drum 121 (the width direction of the sheet). The shielding sponge 60 blocks the airflow flowing from the location around the transfer unit 180M in a direction intersecting the axial direction of the transfer unit 180M toward the cooling airflow passage AP. According to the present embodiment, the shielding sponge 60 is a member made of sponge material (elastic member) disposed in compressed state between the transfer unit 180M and the conveyance unit 1M.

As shown in FIG. 6, the shielding sponges 60 is provided in a pair and disposed on the conveyance unit 1M to have the sheet detection sensor 51 in between. Each shielding sponge 60 extends in the front-to-rear direction. Each shielding sponge 60 is a member made of sponge material and having the shape of a prism. When the transfer unit 180M is mounted to the conveyance unit 1M, each sponge 60 is held in compression between the guide section 183 of the transfer unit 180M and the conveyance unit 1M as shown in FIG. 4.

As a result, the clearance present above the density detection sensor 52 and in the front and the rear of the sheet detection sensor 51 is sealed, and the airflow flowing from a location around the transfer unit 180M is blocked from entering the cooling airflow passage AP. In addition, since the shielding sponges 60 define the upper portion of the cooling airflow passage AP, the cooling airflow blowing through the air outlet 50A is guided linearly toward the rear. As a result, the sheet detection sensor 51 and the density detection sensor 52 are stably cooled by the cooling airflow and protected from adhesion of foreign matter, such as toner particles. Since the shielding sponges 60 are disposed in compression between the transfer unit 180M and the conveyance unit 1M, the airflow from a location around the transfer unit 180M is more reliably blocked from entering the cooling airflow passage AP. The structure described above is advantageous in that the cutaway portion 184 is formed as a part of the guide section 183 that guides the sheet P detached from the conveyance belt 180 and that the shielding sponges 60 are disposed between the guide section 183 and the conveyance unit 1M.

Figure 10:
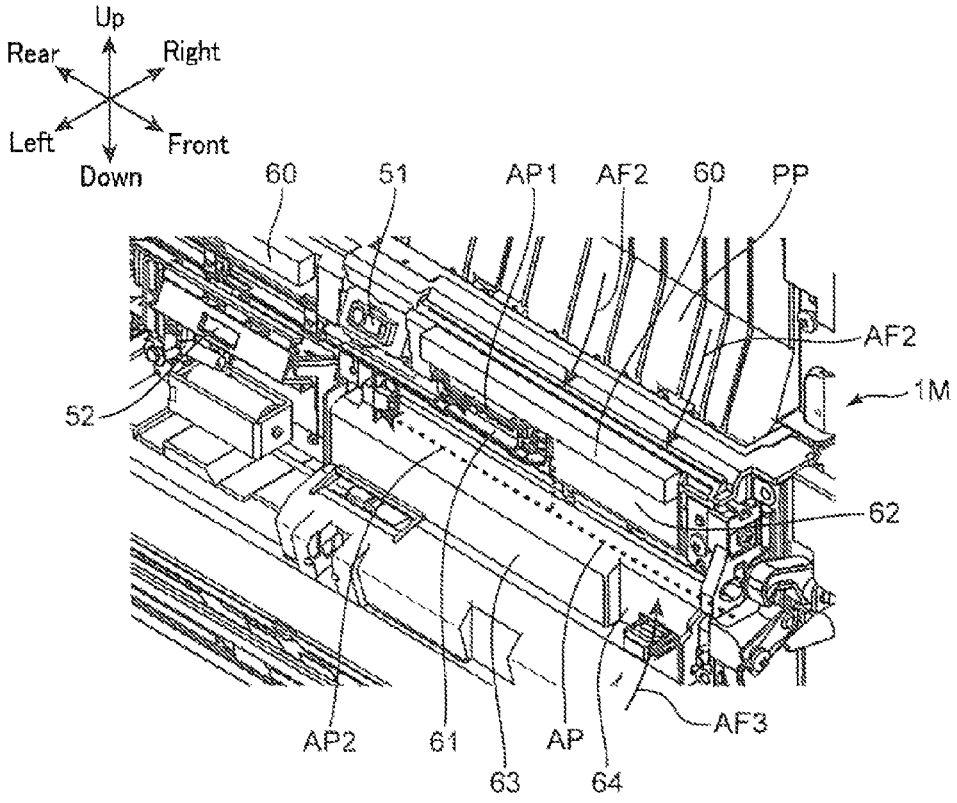
FIG. 10 is a perspective view of the airflow passage inside a cooling airflow passage according to the embodiment of the present disclosure.
Figure 11:
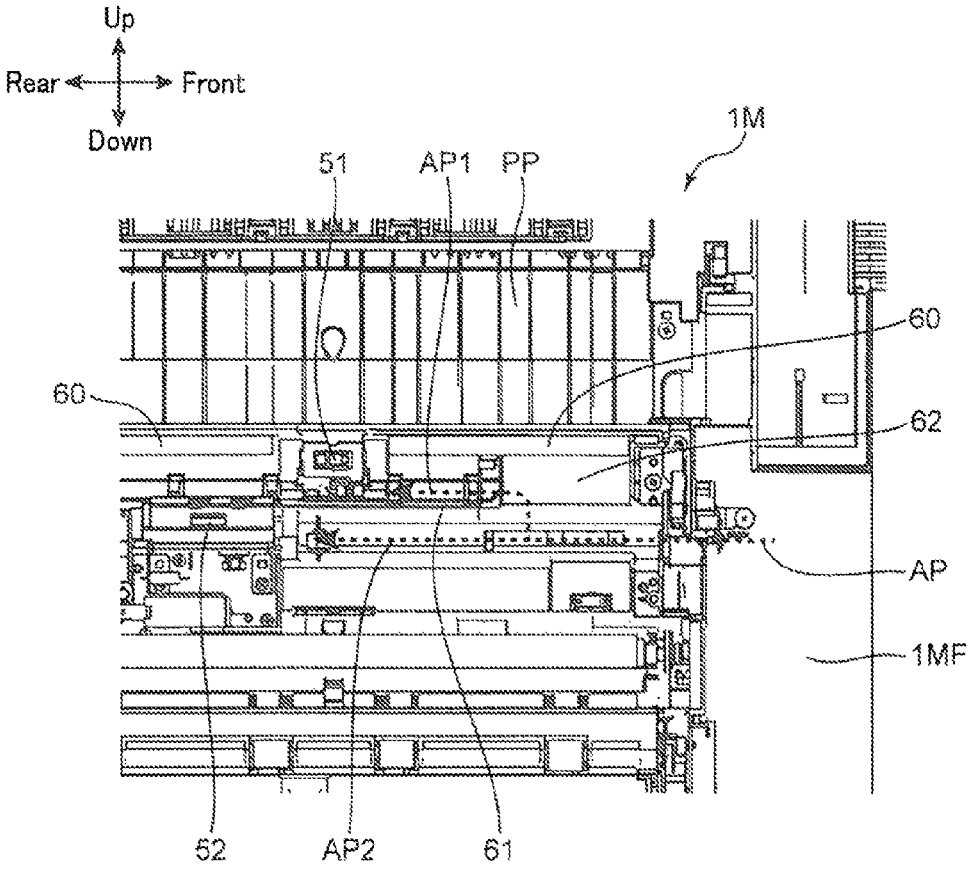
FIG. 11 is a side view of the airflow passage inside the cooling airflow passage according to the embodiment of the present disclosure.
Figure 12:
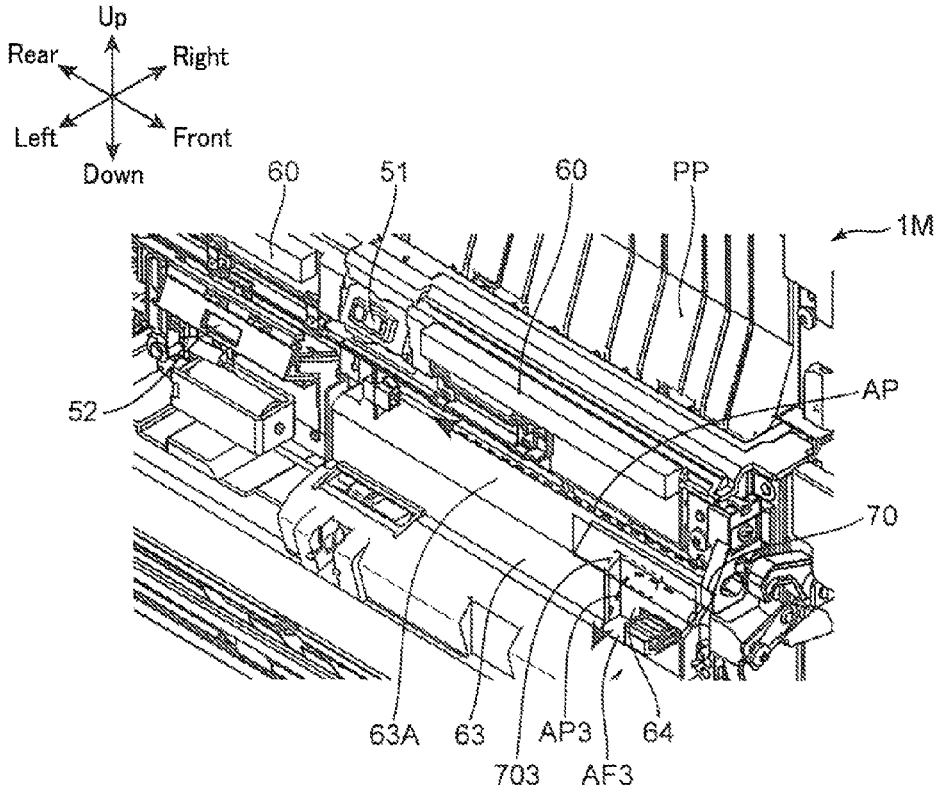
FIG. 12 is a perspective view showing the conveyance unit according to the embodiment of the present disclosure, with a flow dividing mechanism attached thereto.
Figure 13A:
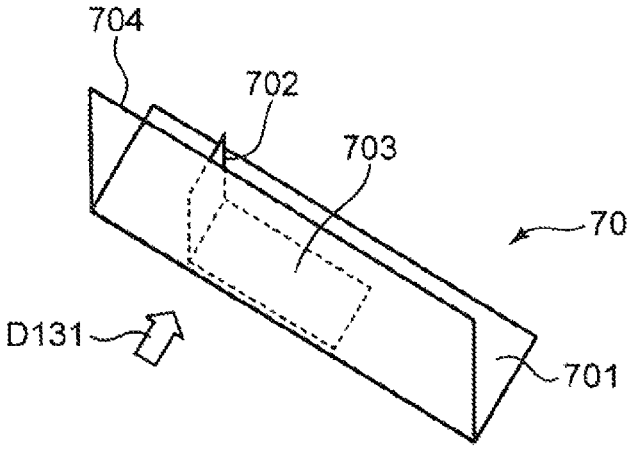
FIG. 13A is a perspective view of the flow dividing mechanism according to the embodiment of the present disclosure.
Figure 13B:
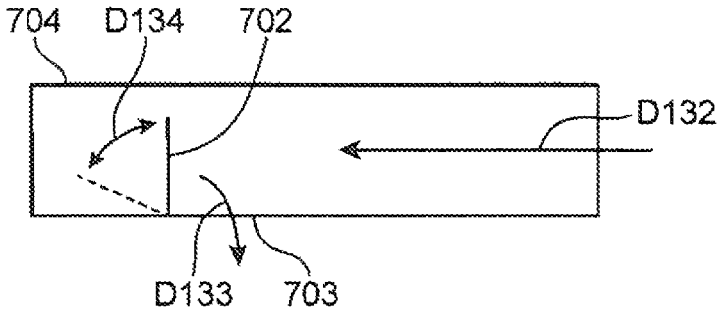
FIG. 13B is a side view of the flow dividing mechanism according to the embodiment of the present disclosure.
Figure 13C:
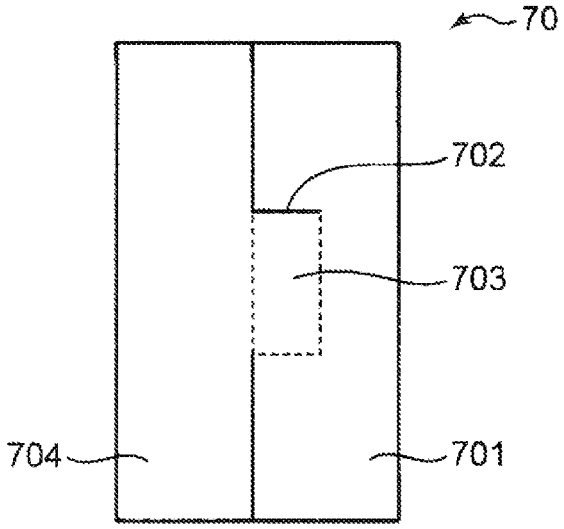
FIG. 13C is a developed view of the flow dividing mechanism according to the embodiment of the present disclosure.

FIG. 10 is a perspective view and FIG. 11 is a side view of the cooling airflow inside the cooling airflow passage AP between the transfer unit 180M and the conveyance unit 1M. FIG. 12 is a perspective view showing the conveyance unit 1M according to the present embodiment, with a first dividing member 70 attached thereto. FIG. 13A is a perspective view of the first dividing member 70 according to the present embodiment. FIG. 13B is a side view of the first dividing member 70 according to the present embodiment. FIG. 13C is a developed view of the first dividing member 70 according to the present embodiment.

According to the present embodiment, the reverse guide section 145 extends in the up-and-down direction at the right of both the shielding sponges 60. Therefore, the shielding sponges 60 disposed between the transfer unit 180M and the conveyance unit 1M prevent the airflow (indicated by an arrow AF2 shown in FIG. 10) occurring in the sheet conveyance passage PP from entering the cooling airflow passage AP.

According to the present embodiment, in addition, the conveyance unit 1M further includes a partition member 61, a left wall 62, an airflow passage lower wall 63, and an upstream concave portion 64 (see FIG. 10). The left wall 62 is a wall disposed in the conveyance unit 1M at a location below the shielding sponges 60 to face toward the left. The airflow passage lower wall 63 projects toward the left from a lower portion of the left wall 62. The airflow passage lower wall 63 defines the lower portion of the cooling airflow passage AP in the axial direction of the photosensitive drum 121. As shown in FIG. 12, the airflow passage lower wall 63 has an upper surface portion 63A. The upper surface portion 63A defines an upper surface of the airflow passage lower wall 63. The upper surface portion 63A is downwardly inclined form the right to the left. The upstream concave portion 64 is formed by depressing a part of a front end portion of the airflow passage lower wall 63 toward the right. The upstream concave portion 64 is formed in the airflow passage lower wall 63 at an upstream location in the cooling airflow through the cooling airflow passage AP. In addition, the upstream concave portion 64 defines a part of a communication airflow passage AP3, which will be described later, and in communication with a first opening 703, which is also described later.

The partition member 61 is a plate that projects from the left wall 62 of the conveyance unit 1M in the axial direction of the photosensitive drum 121. The partition member 61 has a predetermined width in the right-and-left direction and extends in the front-to-rear direction. The partition member 61 defines a part of the cooling airflow passage AP. Therefore, the partition member 61 promotes the cooling airflow in the axial direction.

As described above, the sheet detection sensor 51 and the density detection sensor 52 are at different locations in the sheet conveyance direction (up-and-down direction). The partition member 61 is disposed between the sheet detection sensor 51 and the density detection sensor 52 in the up-and-down direction. As shown in FIGS. 10 and 11, the partition member 61 therefore divides the cooling airflow into a first cooling airflow AP1 and a second cooling airflow AP2, which flows below the first cooling airflow AP1. The cooling airflow from the sirocco fan 50 flows out of the air outlet 50A to enter the cooling airflow passage AP. The first cooling airflow AP1 is guided to the sheet detection sensor 51. The second cooling airflow AP2 is guided to the density detection sensor 52. As a result, the cooling airflow is guided toward the respective detection sensors. Therefore, the sheet detection sensor 51 and the density detection sensor 52 are stably cooled.

According to the present embodiment, in addition, the partition member 61 functions to position the electric wires extending from the sheet detection sensor 51 and the density detection sensor 52. That is, the respective electric wires extending from the sheet detection sensor 51 and the density detection sensor 52 are disposed along the partition member 61 to be connected to a non-illustrated electric substrate of the conveyance unit 1M. That is, the partition member 61 used for guiding the cooling airflow is also used to position the electric wires of the sheet detection sensor 51 and the density detection sensor 52.

On the other hand, as shown in FIGS. 3 and 10, when a strong cooling airflow blows from the sirocco fan 50 into the cooling airflow passage AP, the air around the transfer unit 180M is drawn into the clearance between the transfer unit 180M and the conveyance unit 1M. As shown in FIGS. 3 and 10, a space formed at a location upstream from the sheet detection sensor 51 and the density detection sensor 52 in the path of the cooling airflow is defined as a communication airflow passage AF3. The communication airflow passage AF3 provides a communication between a location around the transfer unit 180M and the cooling airflow passage AP through the clearance present between the transfer unit 180M and the conveyance unit 1M. The communication provided by the communication airflow passage AF3 connects the location around the transfer unit 180M to the cooling airflow passage AP in the direction intersecting the axial direction of the photosensitive drum 121. If toner particles are scattered around the transfer unit 180M, it is generally possible that such toner particles adhere to the sheet detection sensor 51 or the density detection sensor 52. As a result, the sheet detection sensor 51 or the density detection sensor 52 may malfunction.

In addition, when the cooling airflow from the sirocco fan 50 enters the cooling airflow passage AP through the air outlet 50A (FIG. 9), an airflow may be induced to flow from the location around the transfer unit 180M through the upstream concave portion 64 shown in FIG. 10 to enter the cooling airflow passage AP. If this occurs, the induced airflow interferes with the cooling airflow flowing into the cooling airflow passage AP. This reduces the cooling of the sheet detection sensor 51 and the density detection sensor 52.

According to the present embodiment, however, the conveyance unit 1M is provided with the first dividing member 70 (FIGS. 12 and 13) (dividing mechanism). The first dividing member 70 functions such that part of the cooling air flowing from the sirocco fan 50 in the cooling airflow passage AP is directed into the communication airflow passage AP3.

As shown in FIGS. 13A to 13C, the first dividing member 70 has a first fixed surface 701 (fixed surface), a first shielding surface 702 (shielding surface), the first opening 703 (opening), and a first partition surface 704 (partition surface). FIG. 13B is a side view of the first dividing member 70 as seen from the direction of an arrow D131 in FIG. 13A (from the left in FIG. 12). According to the present embodiment, the first dividing member 70 is formed out of a single rectangular plate member as shown in FIG. 13C. The plate member is bent substantially along the widthwise center to define the first fixed surface 701 and the first partition surface 704. Then, the first fixed surface 701 is partially cut at the longitudinal center so as to form the first shielding surface 702 and the first opening 703.

The first fixed surface 701 is fixed to the upper surface portion 63A of the airflow passage lower wall 63 so as to cover the upstream concave portion 64 (FIG. 12) from above.

The first opening 703 is formed in the first fixed surface 701 that defines a part of the cooling airflow passage AP and provides a communication between the cooling airflow passage AP and the communication airflow passage AF3. The first shielding surface 702 is located downstream from the first opening 703 in the cooling airflow and blocks part of the cooling airflow.

To describe the first fixed surface 701, the first shielding surface 702, and the first opening 703 in another way, the first opening 703 is a rectangular hole formed in the first fixed surface 701 so as to have an edge at a location downstream in the cooling airflow. The first shielding surface 702 extends from the downstream edge of the first opening 703 toward inside the cooling airflow passage AP. The first shielding surface 702 is pivotable on the downstream edge of the first opening 703 as the pivot (indicated by an arrow D134 shown in FIG. 13B) to adjust the angle formed with the first opening 703 of the first shielding surface 702.

In addition, the first partition surface 704 meets the first fixed surface 701 at an angle. With the first fixed surface 701 fixed to the upper surface portion 63A, the first partition surface 704 comes to face the transfer unit 180M. The first partition surface 704 defines a part of the cooling airflow passage AP in the axial direction of the photosensitive drum 121. By the first partition surface 704, the cooling airflow flowing in the cooling airflow passage AP is guided toward the sheet detection sensor 51 and the density detection sensor 52 in the axial direction of the photosensitive drum 121.

As shown in FIG. 13B, the cooling airflow flowing through the air outlet 50A of the sirocco fan 50 as indicated by an arrow D132 is partly blocked and temporality stagnated by the first shielding surface 702 and then flows into the communication airflow passage AF3 through the first opening 703 as indicated by an arrow D133. According to the present embodiment as described above, part of the cooling airflow flowing form the sirocco fan 50 into the cooling airflow passage AP is guided by the first dividing member 70 into the communication airflow passage AF3. As a result, an airflow is created in the communication airflow passage AF3 to flow in a direction from the cooling airflow passage AP toward the location around the transfer unit 180M (an arrow AP3 in FIG. 12). This prevents the entry of airflow from the location around the transfer unit 180M into the cooling airflow passage AP. That is, part of the cooling airflow is used to seal the first opening 703. Consequently, the sheet detection sensor 51 and the density detection sensor 52 are stably cooled by the cooling airflow while duly protected from adhesion of foreign matter, such as toner particles. In addition, the angle that the first shielding surface 702 forms with the first opening 703 can be adjusted to regulate the amount of cooling airflow flowing into the communication airflow passage AF3. That is to say, depending of the configuration of the communication airflow passage AF3, an appropriate adjustment can be made to regulate the amount of airflow for cooling the sheet detection sensor 51 and the density detection sensor 52 as well as the amount of airflow for sealing the communication airflow passage AF3.

Up to this point, the image forming apparatus according to the embodiment of the present disclosure has been described. However, the present disclosure is not limited to the specific embodiment. For example, an alteration described below may be made.

(1) According to the embodiment described above, the sponge material is used as the shielding members disposed between the transfer unit 180M and the conveyance unit 1M. However, this should not be taken to limit the present disclosure. The shielding member may be a film that extends in the width direction of the sheet P in a manner to span a gap between the transfer unit 180M and the conveyance unit 1M.

(2) According to the embodiment described above, the conveyance unit 1M is provided with the sheet detection sensor 51 and the density detection sensor 52. However, this should not be taken to limit the present disclosure. The conveyance unit 1M may be provided with an additional detection sensor. Further, an additional sensor may be disposed on the transfer unit 180M to face the conveyance unit 1M.

(3) According to the embodiment described above, the first dividing member 70 is described as the dividing mechanism.

Figure 14:
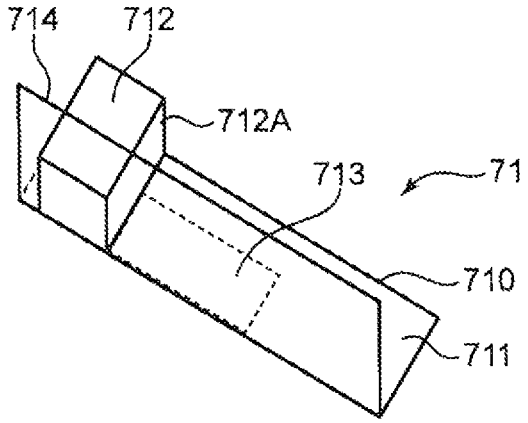
FIG. 14 is a perspective view of a flow dividing mechanism according to a variation of the present disclosure.

However, this should not be taken to limit the present disclosure. FIG. 14 is a perspective view of a second dividing member 71 (dividing mechanism) according to an altered embodiment of the present disclosure. The second dividing member 71 includes a plate portion 710 (plate member) and a shielding block 712 (elastic member). The plate portion 710 has a second fixed surface 711 (fixed surface), a second opening 713 (opening), and a second partition wall 714 (partition wall). The second fixed surface 711 and the second partition wall 714 respectively correspond to the first fixed surface 701 and the first partition surface 704 of the first dividing member 70 described with reference to FIG. 13. The second opening 713 is a rectangular hole formed through the second fixed surface 711. The shielding block 712 is disposed on the second fixed surface 711 at a location downstream from the second opening 713. The shielding block 712 is a member made of sponge material and having a rectangular parallelepiped shape. The shielding block 712 has a second shielding surface 712A. The second shielding surface 712A has the same function as the first shielding surface 702 of the first dividing member 70 described with reference to FIG. 13.

With the configuration of the alteration, part of the cooling airflow from the sirocco fan 50 is blocked by the second shielding surface 712A of the shielding block 712, which facilitates the entry of the airflow into enter the second opening 713. Therefore, the provision of the shielding block 712 on the second fixed surface 711 of the plate portion 710 can permit the entry of part of the cooling airflow into the communication airflow passage AF3.

(4) According to the embodiment described above, the first dividing member 70 is fixed to the upper surface portion 63A of the airflow passage lower wall 63. However, this should not be taken to limit the present disclosure. The first dividing member 70 or the second dividing member 71 may be disposed slidable in the axial direction of the photosensitive drum 121 to vary the area of the first opening 703 or the second opening 713 that is in communication with the upstream concave portion 64. With this configuration, the amount of cooling airflow entering the communication airflow passage AF3 through the first opening 703 or the second opening 713 can be adjusted by sliding the first dividing member 70 or the second dividing member 71. That is to say, depending of the configuration of the communication airflow passage AF3, an appropriate adjustment can be made to regulate the amount of airflow for cooling the sheet detection sensor 51 and the density detection sensor 52 as well as the amount of airflow for sealing the communication airflow passage AF3.

(5) According to the embodiment described above, the first shielding surface 702 extending from the first fixed surface 701 has a fixed length. However, this should not be taken to limit the present disclosure. The length of the first shielding surface 702 may be altered to adjust the amount of airflow for cooling the sheet detection sensor 51 and the density detection sensor 52 as well as the amount of airflow for shielding the communication airflow passage AF3.

What is claimed is:

1. An image forming apparatus comprising:

a sheet conveyance passage through which a sheet is conveyed in a predetermined conveyance direction;

a photosensitive drum having an axis and a peripheral surface and disposed to face the sheet conveyance passage, the photosensitive drum being configured to axially rotate and bear a toner image on the peripheral surface, a transfer unit including a conveyance belt disposed to face the photosensitive drum across the sheet conveyance passage and to form a nip part with the photosensitive drum, the conveyance belt being configured to circulate, the transfer unit being configured to pass the sheet through the nip part to cause the toner image to be transferred to the sheet;

a fixing section disposed downstream from the nip part in the conveyance direction, the fixing section being configured to conduct a fixing process on the sheet to which the toner image has been transferred;

a conveyance unit disposed at an opposite side of the transfer unit from the photosensitive drum with a predetermined clearance from the transfer unit, the conveyance unit being configured to convey the sheet having been subjected to the fixing process back into the sheet conveyance passage at a location upstream from the nip part in the conveyance direction;

at least one detection sensor disposed in the conveyance unit so as to face the transfer unit in a cross section intersecting an axial direction of the photosensitive drum, the at least one detection sensor being configured to perform a predetermined detection;

an airflow generating section configured to cause a cooling airflow to flow between the transfer unit and the conveyance unit in the axial direction;

a cooling airflow passage disposed between the transfer unit and the conveyance unit, the cooling airflow passage being configured to guide the cooling airflow toward the at least one detection sensor; and a shielding member disposed in the clearance between the transfer unit and the conveyance unit to extend in the axial direction, the shielding member being configured to block an airflow from a location around the transfer unit toward the cooling airflow passage in a direction intersecting the axial direction.

2. An image forming apparatus according to claim 1, wherein the shielding member is an elastic member disposed in compression between the transfer unit and the conveyance unit.

3. An image forming apparatus according to claim 1, wherein the transfer unit further includes a cutaway portion to partly expose the conveyance unit toward the sheet conveyance passage at a location downstream from the conveyance belt in the conveyance direction, and the at least one detection sensor is a sheet sensor disposed in the conveyance unit so as to face the cutaway portion and configured to detect, through the cutaway portion, the sheet conveyed from the nip part.

4. An image forming apparatus according to claim 3, wherein the transfer unit further includes a guide section configured to guide the sheet detached from the conveyance belt in the conveyance direction, the cutaway portion is included in the guide section, and the shielding member is disposed between the guide section and the conveyance unit.

5. An image forming apparatus according to claim 1, wherein the at least one detection sensor is a density sensor disposed in the conveyance unit so as to face the conveyance belt and configured to detect a density of a toner image that is formed on the conveyance belt for density detection.

6. An image forming apparatus according to claim 1, further comprising:

a partition member that projects from the conveyance unit in the axial direction and defines a part of the cooling airflow passage.

7. An image forming apparatus according to claim 6, wherein the at least one detection sensor comprises a plurality of detection sensors disposed at different locations in the conveyance direction, and the partition member divides the cooling airflow from the airflow generating section into a plurality of airflows toward the respective detection sensors.

8. An image forming apparatus according to claim 6, wherein the partition member is configured to position an electric wire extending from the at least one detection sensor.

9. An image forming apparatus according to claim 1, further comprising:

a communication airflow passage disposed upstream from the at least one detection sensor in the cooling airflow, the communication airflow passage providing, through the clearance between the transfer unit and the conveyance unit, a communication between the location around transfer unit and the cooling airflow passage in a direction intersecting the axial direction; and a dividing mechanism configured to cause part of the cooling airflow flowing from the airflow generating section through the cooling airflow passage to enter the communication airflow passage.

10. An image forming apparatus according to claim 9, wherein the dividing mechanism includes an opening that opens in the cooling airflow passage to provide a communication between the cooling airflow passage and the a communication airflow passage, and a shielding surface disposed downstream from the opening in the cooling airflow to block part of the cooling airflow.

11. An image forming apparatus according to claim 10, wherein the opening has a rectangular shape an edge of which is located downstream in the cooling airflow, and the shielding surface extends from the edge toward inside the cooling airflow passage and is pivotable on the edge such that an angle of the shielding surface is adjustable relative to the opening.

12. An image forming apparatus according to claim 11, wherein the conveyance unit includes a wall that defines a part of the cooling airflow passage in the axial direction, the wall has a concave portion that defines a part of the communication airflow passage and that is in communication with the opening, and the dividing mechanism includes a fixed surface fixed to the wall so as to cover the concave portion, and the opening and the shielding surface formed by partially cutting the fixed surface.

13. An image forming apparatus according to claim 10, further comprising:

an elastic member disposed downstream from the opening in the cooling airflow, the shielding surface being a surface of the elastic member.

14. An image forming apparatus according to claim 13, wherein the conveyance unit includes a wall that defines a part of the cooling airflow passage in the axial direction, the wall has a concave portion that defines a part of the communication airflow passage and that is in communication with the opening, the dividing mechanism includes a plate member having a fixed surface fixed to the wall so as to cover the concave portion, and the opening in the fixed surface, and the elastic member is fixed to the fixed surface at a location downstream from the opening in the cooling airflow.

15. An image forming apparatus according to claim 12, wherein the dividing mechanism includes a partition surface that meets the fixed surface at an angle, the partition surface being disposed to face the transfer unit and defining a part of the cooling airflow passage in the axial direction.

16. An image forming apparatus according to claim 12, wherein the dividing mechanism is slidable in the axial direction to change an area of the opening that is in communication with the concave portion.

* * * * *